US008821197B2

(12) United States Patent
Muro

(10) Patent No.: US 8,821,197 B2
(45) Date of Patent: Sep. 2, 2014

(54) FUSE TERMINAL

(75) Inventor: Takashi Muro, Makinohara (JP)

(73) Assignee: Yazaki Corporation, Tokyo (JP)

( * ) Notice: Subject to any disclaimer, the term of this patent is extended or adjusted under 35 U.S.C. 154(b) by 34 days.

(21) Appl. No.: 13/515,540

(22) PCT Filed: Dec. 16, 2010

(86) PCT No.: PCT/JP2010/072717

§ 371 (c)(1),
(2), (4) Date: Jun. 13, 2012

(87) PCT Pub. No.: WO2011/074653

PCT Pub. Date: Jun. 23, 2011

(65) Prior Publication Data

US 2012/0252283 A1 Oct. 4, 2012

(30) Foreign Application Priority Data

Dec. 17, 2009 (JP) ..... 2009-286294

(51) Int. Cl.
*H01R 11/22* (2006.01)

(52) U.S. Cl.
USPC ..... 439/852; 439/830; 439/858

(58) Field of Classification Search
USPC ..... 439/852, 853, 858–860, 856
See application file for complete search history.

(56) References Cited

U.S. PATENT DOCUMENTS

| | | | | |
|---|---|---|---|---|
| 5,666,723 | A | 9/1997 | Ohtaka et al. | |
| 5,685,747 | A | 11/1997 | Rodriguez | |
| 6,152,788 | A * | 11/2000 | Hata et al. | 439/852 |
| 6,506,084 | B2 * | 1/2003 | Saitoh | 439/852 |
| 6,544,080 | B1 * | 4/2003 | Yamamoto | 439/849 |
| 6,547,608 | B2 * | 4/2003 | Sato et al. | 439/852 |
| 6,761,597 | B2 * | 7/2004 | Shimizu | 439/852 |
| 7,147,522 | B2 * | 12/2006 | Kobayashi et al. | 439/852 |
| 2002/0155763 | A1 | 10/2002 | Saitoh | |
| 2004/0157503 | A1 | 8/2004 | Fujii | |

FOREIGN PATENT DOCUMENTS

| | | | |
|---|---|---|---|
| EP | 1148589 | A2 | 10/2001 |
| JP | 63-124385 | A | 5/1988 |
| JP | 05-251143 | A | 9/1993 |
| JP | 07-045321 | A | 2/1995 |

(Continued)

OTHER PUBLICATIONS

International Search Report for PCT/JP2010/072717 dated Jan. 11, 2011 [PCT/ISA/210].

(Continued)

*Primary Examiner* — Hien Vu
(74) *Attorney, Agent, or Firm* — Sughrue Mion, PLLC

(57) ABSTRACT

In a fuse terminal in which a frame is formed by a bottom wall part, a pair of sidewall parts and a top wall part, a pair of contact terminals are respectively arranged at right and left positions within the frame, and the tab terminal of a fuse advanced into the frame is inserted between the pair of contact terminals and closely made in contact therebetween by contact loads due to elastic restoring forces of the pair of contact terminals, one of the contact terminals is a wound spring type contact terminal which is formed by being extended from the frame and folded for a plurality of times along the one sidewall part, and the other contact terminal is a leaf-spring type contact terminal which is extended from the frame through a flexible rod part and arranged almost in parallel to the other sidewall part via a gap.

7 Claims, 9 Drawing Sheets

(56) References Cited

FOREIGN PATENT DOCUMENTS

| | | | |
|---|---|---|---|
| JP | 2002-078153 | A | 3/2002 |
| JP | 2002-246094 | A | 8/2002 |
| JP | 2004-206912 | A | 7/2004 |
| RU | 2 310 957 | C1 | 11/2007 |

OTHER PUBLICATIONS

Written Opinion for PCT/JP2010/072717 dated Jan. 11, 2011 [PCT/ISA/237].

Official Decision of Grant issued Oct. 15, 2013 by the Federal Service on Intellectual Property in corresponding Russian Application No. 2012124910/07.

Office Action dated Sep. 17, 2013, issued by the Japanese Patent Office in counterpart Japanese Application No. 2009-286294.

Office Action dated Feb. 24, 2014, issued by the State Intellectual Property Office in counterpart Chinese Application No. 201080057771.4.

* cited by examiner

FUSE TERMINAL

TECHNICAL FIELD

The present invention relates a fuse terminal to which the tab terminal of a fuse is coupled.

BACKGROUND ART

There is a case that a fuse is disposed within a circuit by using a fuse connector. The fuse connector includes a connector housing having a plurality of aligned terminal housing rooms and a plurality of fuse terminals housed within each of the terminal housing rooms. The fuse includes a fuse body for supporting a fusible part and a pair of tab terminals which are supported by the fuse body and coupled to the fusible part. Then, the pair of tab terminals of the fuse are inserted into a pair of the adjacent fuse terminals within the connector housing, whereby the fusible part of the fuse is disposed between the pair of fuse terminals.

This kind of the fuse terminal of the related art is disclosed in a patent literature 1, for example. As shown in FIGS. 11 to 13, this fuse terminal 50 is fabricated by subjecting a conductive member stamped into a predetermined shape to a bending process. The fuse terminal 50 is configured by a terminal contact part 51 and an electric wire crimping part 70. The terminal contact part 51 includes a pair of side wall parts 53, 54 fabricated by bending a bottom wall part 52 and portions respectively extended from the both side ends thereof, and a top wall part 55 fabricated by bending the upper end of each of the side wall parts 53, 54. A square-shaped frame 56 is configured by the bottom wall part 52, the pair of side wall parts 53, 54 and the top wall part 55. A front wall part 57 formed by bending the front ends of the side wall parts 53, 54 and the front end of the bottom wall part 52 is disposed at the front surface of the frame 56. A front insertion port 58 is formed by an area not covered by the front wall part 57. An upper insertion port 59 communicating with the front insertion port 58 is formed at the top wall part 55. The tab terminal (not shown) of the fuse is inserted within the frame 56 from the front insertion port 58 and the upper insertion port 59.

A pair of contact terminals 60, 60 formed by subjecting the notched portion of each of the pair of side wall parts 53, 54 to an inward bending process are disposed within the frame 56. Since the contact terminals 60, 60 are integrally formed at the rear ends thereof with the side wall parts 53, 54, respectively, each of the contact terminals acts as a contact terminal of a cantilever type and a leaf spring type. Notched parts 60*a*, 60*a* are formed at the lower portions of the tip end sides of the contact terminals 60, 60, respectively.

In the aforesaid configuration, when the tab terminal (not shown) of the fuse is inserted within the frame 56, the tab terminal is inserted between the pair of contact terminals 60, 60. When the tab terminal is made in contact with the pair of contact terminals 60, 60, each of the pair of contact terminals 60, 60 elastically deforms to the outside to allow the insertion of the tab terminal, whereby the tab terminal is inserted to an insertion completion position. The pair of contact terminals 60, 60 and the tab terminal are closely made in contact from one another by a contact load due to the elastic restoring force of each of the contact terminals 60, 60.

PRIOR ART LITERATURE

Patent Literature

Patent Literature 1: JP-A-2004-206912

SUMMARY OF INVENTION

Technical Problem to be Solved by the Invention

According to the fuse terminal 50 of the related art, since each of the pair of contact terminals 60, 60 is elastically deformable, each of the pair of contact terminals elastically deforms at the time of the initial contact of the tab terminal, so that the insertion feeling at the initial time of the terminal insertion is favorable. However, in a state where the tab terminal is inserted completely, since each of the pair of contact terminals 60, 60 is elastically deformable, each of the pair of contact terminals can not form a stable contact point. Thus, there arises a problem that the contact load is not stable. In this respect, it may be considered to fix one of the contact terminals 60. However, in this case, the insertion feeling at the initial time of the terminal insertion degrades.

Further, since the notched parts 60*a*, 60*a* are formed at the tip end sides of the contact terminals 60, 60, respectively, each of the contact terminals 60, 60 is not uniform. Thus, since each of the contact terminals does not deform uniformly, the deformation degree of each of the contact terminals differs depending on a portion where the tab terminal contacts. Also in a view point of this matter, the contact load is not stable. Furthermore, in the state where the tab terminal is inserted completely, since each of the pair of contact terminals 60, 60 is elastically deformable, the contact load at a single point is not sufficient, so that the contact terminals are likely vibrated, for example.

Accordingly, this invention is made in order to solve the aforesaid problems and an object of this invention is to provide a fuse terminal having a favorable insertion feeling at the initial time of terminal insertion and having a stable contact load in an insertion completion state of a tab terminal.

Means for Solving the Problems

The first invention relates to a fuse terminal in which a frame is formed by a bottom wall part, a pair of sidewall parts and a top wall part, a pair of contact terminals are respectively arranged at right and left positions within the frame, and the tab terminal of a fuse advanced into the frame is inserted between the pair of contact terminals and closely made in contact therebetween by contact loads due to elastic restoring forces of the pair of contact terminals, wherein one of the contact terminals is a wound spring type contact terminal which is formed by being extended from the frame and folded for a plurality of times along the one sidewall part, and the other contact terminal is a leaf-spring type contact terminal which is extended from the frame through a flexible rod part and arranged almost in parallel to the other sidewall part via a gap.

The second invention relates to the fuse terminal of the first invention in which the wound spring type contact terminal has a first folding part which is extended from the front end of the one side wall part and then folded back within the frame and a second folding part which is extended from the tip end of the first folding part and then folded back so as to enter between the first folding part and the one side wall part.

The third invention relates to the fuse terminal of the first invention or the second invention in which the leaf-spring type contact terminal is disposed that the tab terminal of the fuse inserted into the frame contacts to the leaf-spring type contact terminal prior to the wound spring type contact terminal.

Advantageous Effects of Invention

According to the first invention, since each of the wound spring type contact terminal and the leaf-spring type contact terminal is elastically deformable, each of these contact terminals elastically deforms at the time of the initial contact with the tab terminal, so that the insertion feeling at the initial time of the terminal insertion is favorable. Further, the wound spring type contact terminal acts as a contact terminal which elastically deforms over the entire insertion process of the tab terminal. However, when the leaf-spring type contact terminal deforms to a degree that it abuts against the other side wall part in the insertion process of the tab terminal, the leaf-spring type contact terminal thereafter acts as a fixed contact terminal. Thus, the leaf-spring type contact terminal forms a stable contact point to thereby stabilize the contact load thereof.

According to the second invention, in addition to the advantageous effects of the first invention, when the tip end side of the second folding part abuts against the other side wall part in the insertion process of the tab terminal, the wound spring type contact terminal acts as a contact terminal which both ends are almost supported (both-end-supported beam) to thereby further stabilize the contact load thereof.

According to the third invention, in addition to the advantageous effects of the first invention or the second invention, the tab terminal inserted into the frame is firstly made in contact with the leaf-spring type contact terminal and so can deform the leaf-spring type contact terminal so as to abut against the other side wall part. As a result, since the leaf-spring type contact terminal can be surely acted as a fixed contact terminal, the stable contact point can be surely formed.

MODES FOR CARRYING OUT THE INVENTION

Hereinafter, an embodiment according to this invention will be explained based on drawings.

Figure 1:
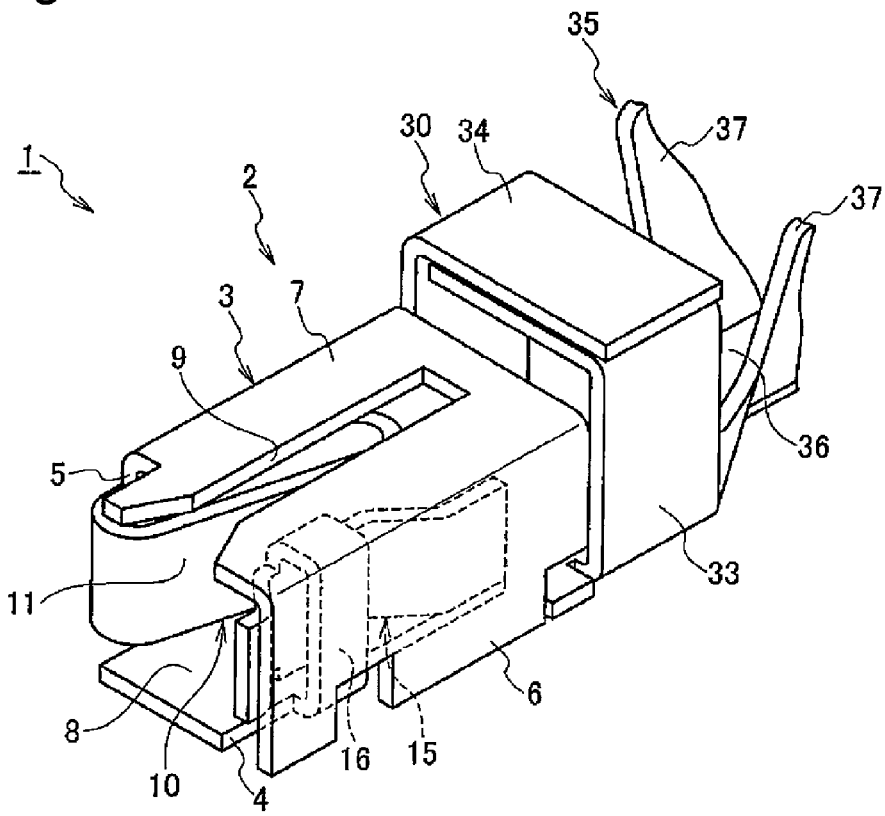
FIG. 1 shows an embodiment of this invention and is a perspective view of the main portion of a fuse terminal.
Figure 2:
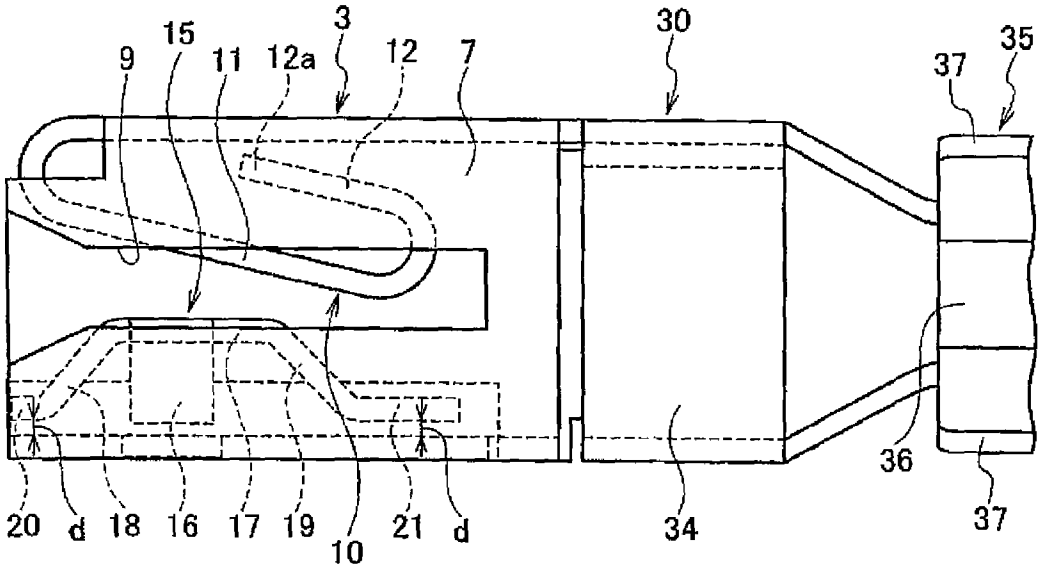
FIG. 2 shows the embodiment of this invention and is a plan view of the main portion of the fuse terminal.
Figure 3:
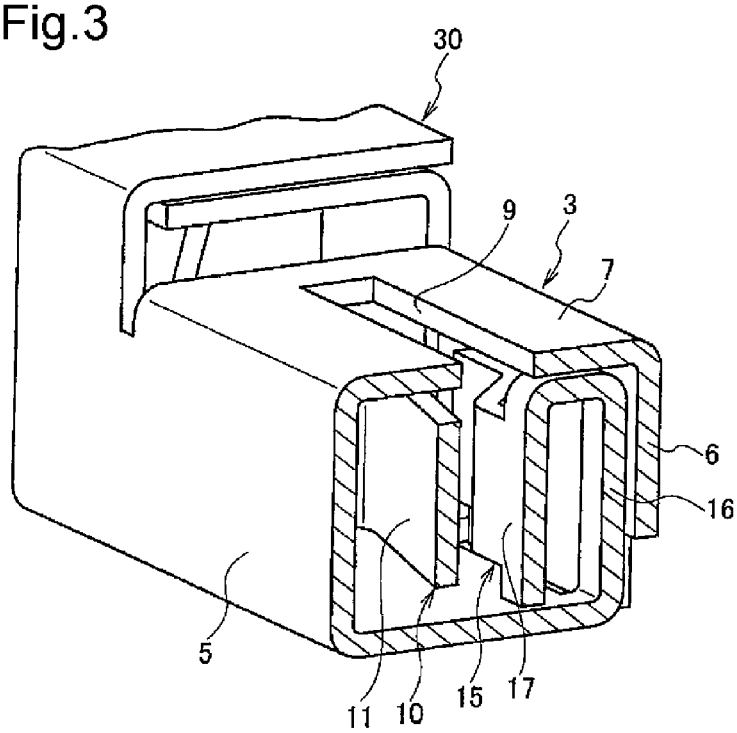
FIG. 3 shows the embodiment of this invention and is a partially-broken perspective view of the main portion of the fuse terminal.
Figure 4:
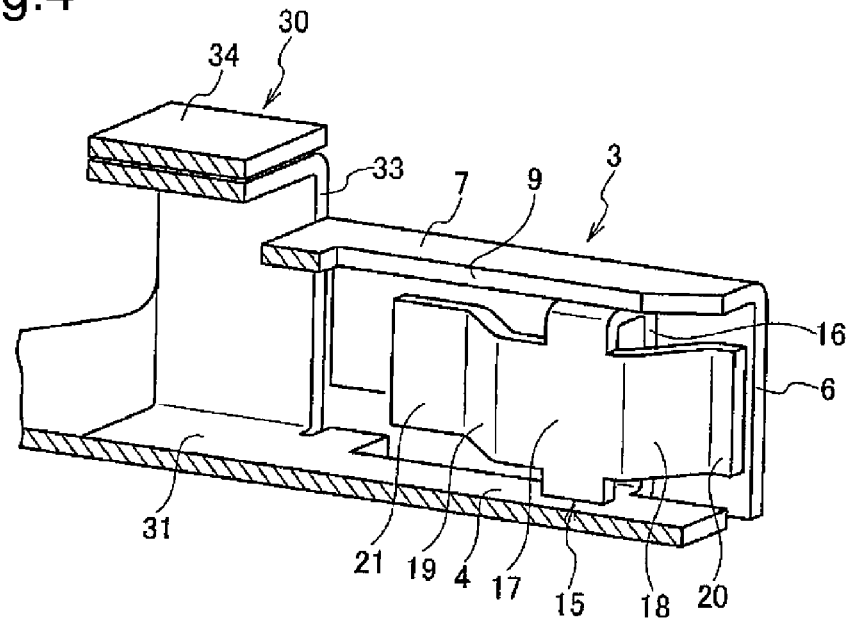
FIG. 4 shows the embodiment of this invention and is a perspective view of the main portion of the fuse terminal partially broken so as to show a leaf-spring type contact terminal.
Figure 5:
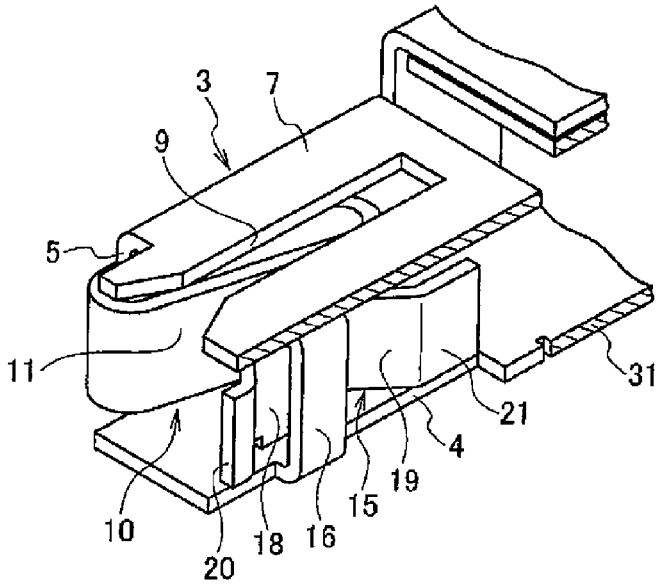
FIG. 5 shows the embodiment of this invention and is a perspective view of the main portion of the fuse terminal partially broken so as to show the leaf-spring type contact terminal.
Figure 6:
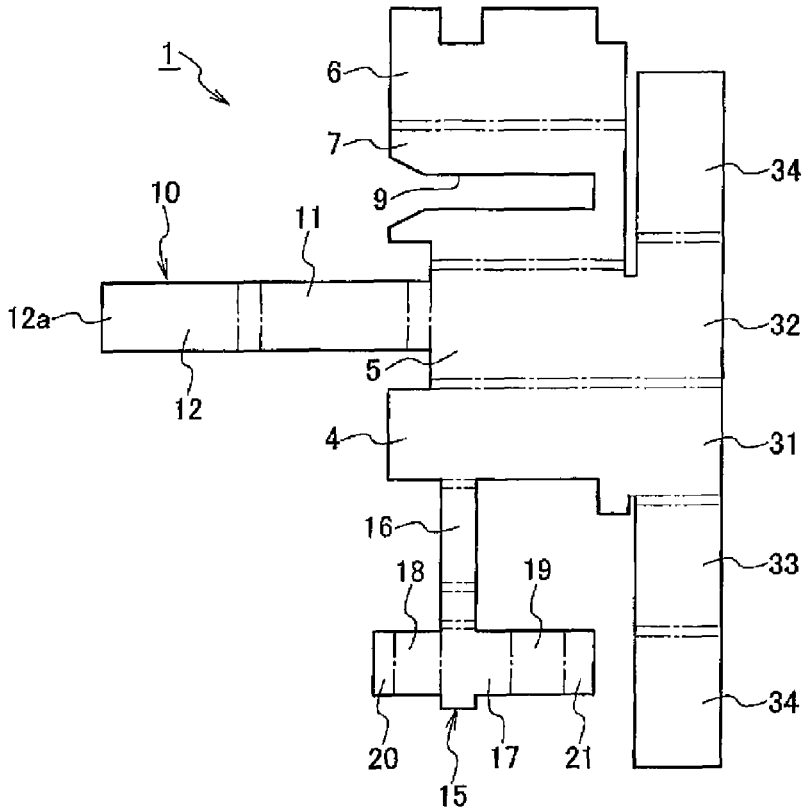
FIG. 6 shows the embodiment of this invention and is a development view of the main portion of the fuse terminal.

FIGS. 1 to 10 show the embodiment according to this invention. FIG. 1 is a perspective view of the main portion of a fuse terminal 1, FIG. 2 is a plan view of the main portion of the fuse terminal 1, FIG. 3 is a partially-broken perspective view of the main portion of the fuse terminal 1, each of FIGS. 4 and 5 is a perspective view of the main portion of the fuse terminal 1 partially broken so as to show a leaf-spring type contact terminal 15, FIG. 6 is a development view of the main portion of the fuse terminal 1, and each of FIGS. 7 to 10 is a sectional view of the main portion showing the insertion state of a tab terminal 40.

The fuse terminal 1 is fabricated by subjecting a conductive member stamped into a predetermined shape shown in FIG. 6 to a bending process. FIG. 6 shows only the terminal coupling part 2 of the fuse terminal 1, in which portions (areas) to be bent are shown by phantom lines.

As shown in FIGS. 1 to 5, the fuse terminal 1 includes the terminal coupling part 2 and an electric wire crimping part 35 and is housed within the cavity room of a fuse housing (not shown). The terminal coupling part 2 includes a front frame 3 as a frame and a rear frame 30 coupled thereto. The front frame 3 is configured by a bottom wall part 4, a pair of side wall parts 5, 6 and a top wall part 7.

The one side wall part 5 is formed in a manner that the one of the both side ends of the bottom wall part 4 is extended and bent upward. The top wall part 7 is formed in a manner that the upper end of the one side wall part 5 is extended and bent in the horizontal direction. The other side wall part 6 is formed in a manner that the side end of the top wall part 7 is extended and bent in the vertical direction. A front terminal insertion port 8 is formed at the front face of the front frame 3. An upper terminal insertion port 9 is formed at the top wall part 7 by notching the top wall part. The upper terminal insertion port 9 and the front terminal insertion port 8 are communicated to each other. The tab terminal 40 (shown in FIGS. 7 to 10) of a fuse (not shown) can be inserted into the front frame 3 from these insertion ports 8, 9. The upper terminal insertion port 9 has a tapered shape on the inlet side thereof to thereby set a large opening width.

A wound spring type contact terminal 10 and the leaf-spring type contact terminal 15 as a pair of contact terminals are disposed at the left and right positions within the front frame 3, respectively. The wound spring type contact terminal 10 is formed in a manner that the front end of the one side wall part 5 is extended and then folded back twice. In detail, the wound spring type contact terminal 10 has a first folding part 11 which is extended from the front end of the one side wall part 5 and then folded back within the front frame 3 and a second folding part 12 which is extended from the tip end of the first folding part 11 and then folded back so as to enter between the first folding part 11 and the one side wall part 5. The first folding part 11 is disposed so as to protrude gradually on the center side in the width direction, toward the rear side thereof (insertion direction of the tab terminal 40) from the front side. The second folding part 12 extends almost in parallel to the first folding part 11 and the free end side 12*a* of the rear end thereof locates near the inner surface of the one side wall part 5.

The leaf-spring type contact terminal 15 is extended from the side end of the bottom wall part 4 via a flexible rod part 16 so as to be disposed almost in parallel to the other side wall part 6 with a gap d therefrom. The flexible rod part 16 is bent upward from the side end of the bottom wall part 4 and the upper end side thereof is further bent downward. The leaf-spring type contact terminal 15 is provided at the tip end of the downwardly bent portion of the flexible rod part so as to extend therethrough. The leaf-spring type contact terminal 15 is configured by a center flat part 17 which is protruded mostly on the center side in the width direction within the front frame 3, a forward inclination part 18 and a backward inclination part 19 which are respectively inclined toward the other side wall part 6 from the front end and the rear end of the center flat part 17, a front end flat part 20 which is bent from the front end of the forward inclination part 18 and disposed so as to be in parallel to the other side wall part 6, and a rear end flat part 21 which is bent from the rear end of the backward inclination part 19 and disposed so as to be in parallel to the other side wall part 6. Each of the front end flat part 20 and the rear end flat part 21 is disposed so as to have the gap d from the other side wall part 6. Thus, the leaf-spring type contact terminal 15 can deform by an amount of the gap d due to the flexible deformation of the flexible rod part 16 but can not deform any more.

The leaf-spring type contact terminal 15 is set at the position that the tab terminal 40 of the fuse inserted into the front frame 3 contacts to the leaf-spring type contact terminal prior to the wound spring type contact terminal 10.

The rear frame 30 is set to be slightly larger than the front frame 3. The rear frame 30 is configured by a bottom wall part 31 extended from the bottom wall part 4 of the front frame 3, a pair of side wall parts 32, 33 and a top wall part 34.

The electric wire crimping part 35 includes a bottom wall part 36 extended from the bottom wall part 31 of the terminal coupling part 2 and a pair of electric wire caulking parts 37 extended from the both side ends of the bottom wall part 36. An electric wire (not shown) is crimped by caulking the electric wire (not shown) by the electric wire caulking parts 37.

Figure 7:
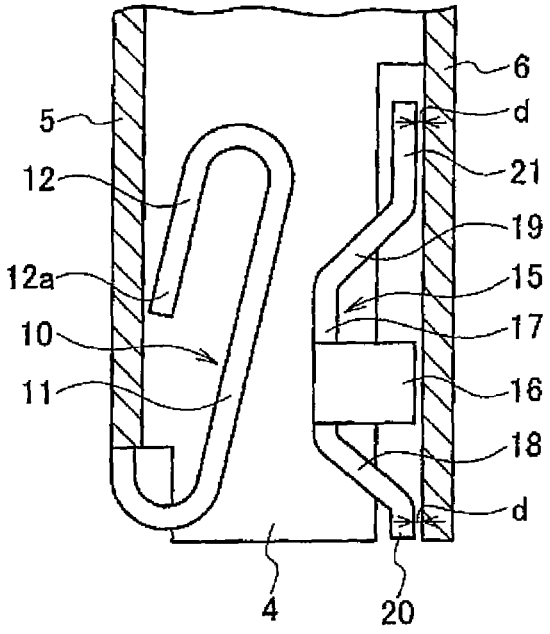
FIG. 7 shows the embodiment of this invention and is a sectional view of the main portion of the fuse terminal before the insertion of a tab terminal.
Figure 8:
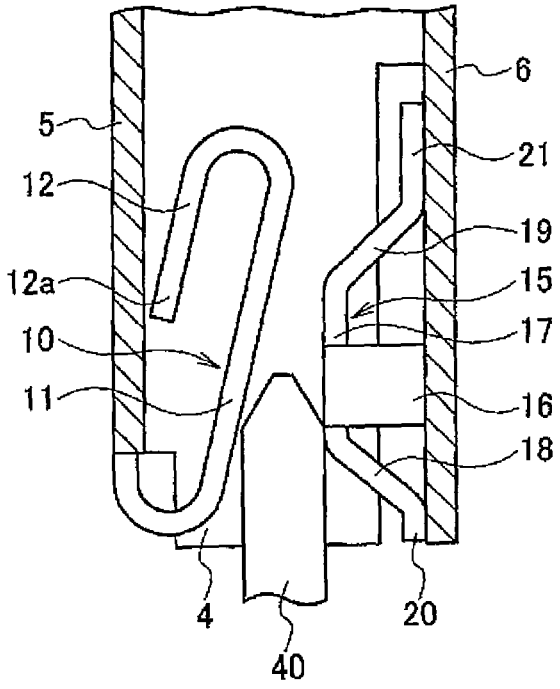
FIG. 8 shows the embodiment of this invention and is a sectional view of the main portion showing a state that the tab terminal is made in contact with the leaf-spring type contact terminal.

Next, the explanation will be made as to the insertion operation of the tab terminal 40 of the fuse (not shown) into the fuse terminal 1 configured in this manner. FIG. 7 shows a state before the insertion of the tab terminal 40 of the fuse into the front frame 3 of the fuse terminal 1. In the state shown in FIG. 7, when the tab terminal 40 of the fuse is inserted into the front frame 3 of the fuse terminal 1 from the front terminal insertion port 8 and the upper terminal insertion port 9, as shown in FIG. 8, the tip end side of the tab terminal 40 is firstly made in contact with the leaf-spring type contact terminal 15. Then, since the leaf-spring type contact terminal 15 receives a pressing force from the tab terminal 40, the flexible rod part 16 flexibly deforms due to the pressing force until the leaf-spring type contact terminal 15 abuts against the inner surface of the other side wall part 6. Thus, the insertion of the tab terminal 40 is allowed.

Figure 9:
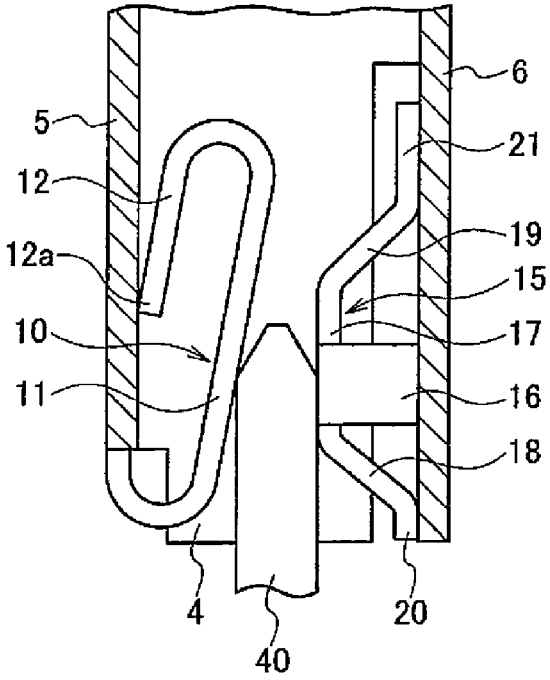
FIG. 9 shows the embodiment of this invention and is a sectional view of the main portion showing a state that the tab terminal is made in contact with the wound spring type contact terminal.
Figure 10:
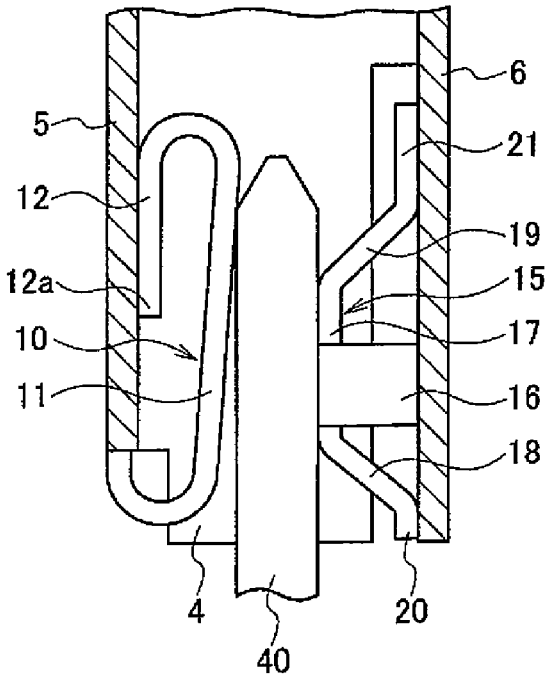
FIG. 10 shows the embodiment of this invention and is a sectional view of the main portion showing a state that the tab terminal is inserted to an insertion completion position.
Figure 11:
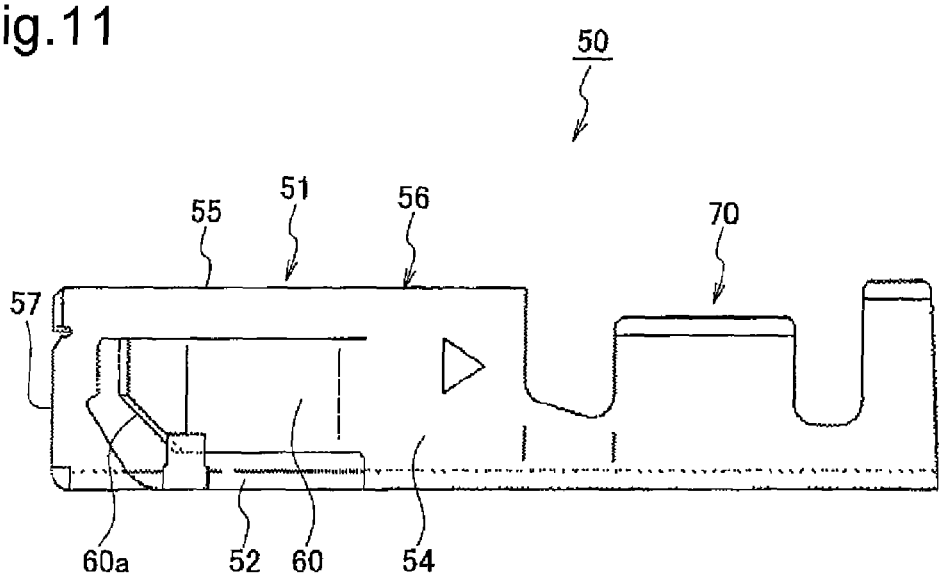
FIG. 11 is a side view of a fuse terminal of an example of the related art.
Figure 12:
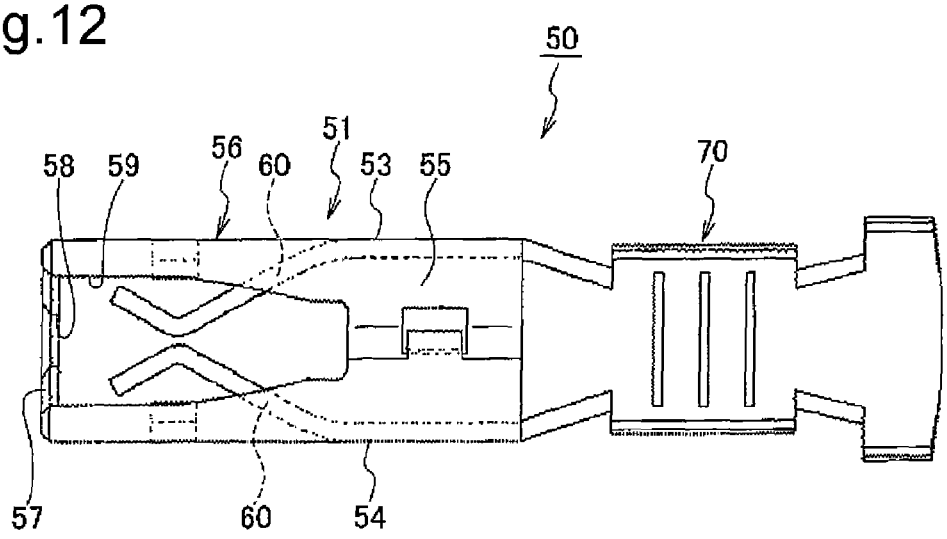
FIG. 12 is a plan view of the fuse terminal of the example of the related art.
Figure 13:
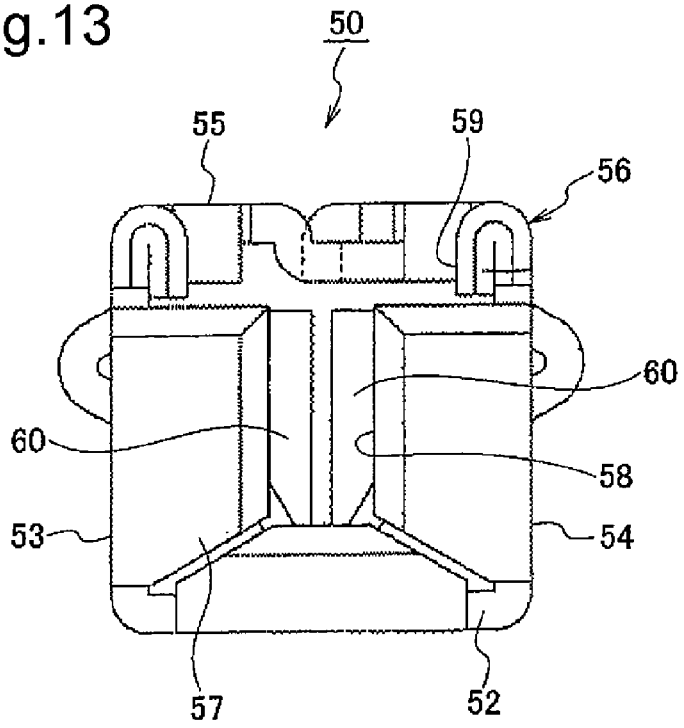
FIG. 13 is a front view of the fuse terminal of the example of the related art.

When the tab terminal 40 is further inserted, as shown in FIG. 9, the tip end side of the tab terminal 40 is made in contact with the wound spring type contact terminal 10. Thus, since the wound spring type contact terminal 10 receives a pressing force from the tab terminal 40, the first folding part 11 flexibly deforms due to the pressing force to thereby allow the further insertion of the tab terminal 40. Due to the flexible deformation of the first folding part 11, the free end side 12*a* of the second folding part 12 abuts against the inner surface of the one side wall part 5. Thereafter, when the pressing force is further applied from the tab terminal 40, each of the first folding part 11 and the second folding part 12 deforms flexibly to thereby allow the furthermore insertion of the tab terminal 40. In this manner, as shown in FIG. 10, the tab terminal 40 can proceed to the insertion completion position. At the insertion completion position of the tab terminal 40, the second folding part 12 deforms to a state where almost the entire region of the second folding part abuts against the inner surface of the one side wall part 5.

As explained above, the front frame 3 is configured by the bottom wall part 4, a pair of the side wall parts 5, 6 and the top wall part 7, and a pair of the contact terminals are disposed at the left and right positions within the front frame 3. The one of the contact terminals is the wound spring type contact terminal 10 which is formed by being extended from the front frame 3 and then folded back twice. The other of the contact terminals is the leaf-spring type contact terminal 15 which is formed by being extended from the front frame 3 via the flexible rod part 16 so as to be disposed almost in parallel to the other side wall part 6 with the gap d therefrom. Thus, since each of the wound spring type contact terminal 10 and the leaf-spring type contact terminal 15 is elastically deformable, each of these contact terminals elastically deforms at the time of the initial contact with the tab terminal, so that the insertion feeling at the initial time of the terminal insertion is favorable. Further, the wound spring type contact terminal 10 acts as a contact terminal which elastically deforms over the entire insertion process of the tab terminal 40. However, when the leaf-spring type contact terminal 15 deforms to a degree that it abuts against the other side wall part 6 in the insertion process of the tab terminal 40, the leaf-spring type contact terminal acts as a fixed contact terminal thereafter. Thus, the leaf-spring type contact terminal 15 forms a stable contact point to thereby stabilize the contact load thereof.

The wound spring type contact terminal 10 has the first folding part 11 which is extended from the front end of the one side wall part 5 and then folded back within the front frame 3 and the second folding part 12 which is extended from the tip end of the first folding part 11 and then folded back so as to enter between the first folding part 11 and the one side wall part 5. Thus, when the free end side 12*a* of the second folding part 12 abuts against the other side wall part 6 in the insertion process of the tab terminal 40, the wound spring type contact terminal 10 acts as a contact terminal which almost both ends are supported (both-end-supported beam) to thereby further stabilize the contact load thereof. Further, the wound spring type contact terminal becomes durable with respect to the vibration.

The leaf-spring type contact terminal 15 is disposed that the tab terminal 40 of the fuse inserted into the front frame 3 contacts to the leaf-spring type contact terminal prior to the wound spring type contact terminal 10. Thus, the tab terminal 40 inserted into the front frame 3 is firstly made in contact with the leaf-spring type contact terminal 15 and so can deform the leaf-spring type contact terminal 15 so as to abut against the other side wall part 6. As a result, since the leaf-spring type contact terminal 15 can be surely acted as the fixed contact terminal, the stable contact point can be surely formed.

According to this embodiment, although the wound spring type contact terminal 10 is formed by being folded back twice, this terminal may be formed by being folded back three times or more.

Although this invention is explained in detail with reference to the particular embodiment, it will be apparent for those skilled in the art that various changes and modifications are possible without departing from the spirit and range of this invention.

This invention is based on Japanese Patent Application (Japanese Patent Application No. 2009-286294) filed on Dec. 17, 2009, the content of which is incorporated herein by reference.

EXPLANATION OF SYMBOLS

1 fuse terminal
3 front frame (frame)
4 bottom wall part
5 one side wall part
6 the other side wall part
7 top wall part
10 wound spring type contact terminal
11 first folding part
12 second folding part
15 leaf-spring type contact terminal
16 flexible rod part
40 tab terminal

The invention claimed is:

1. A fuse terminal comprising a frame is formed by a bottom wall part, a pair of sidewall parts and a top wall part, a pair of contact terminals are respectively arranged at right and left positions within the frame, and a tab terminal of a fuse advanced into the frame is inserted between the pair of contact terminals and closely made in contact therebetween by contact loads due to elastic restoring forces of the pair of contact terminals, wherein one of the contact terminals is a wound spring type contact terminal which is formed by being extended from the frame and folded for a plurality of times along the one sidewall part, and the other contact terminal is a leaf-spring type contact terminal which is extended from the frame through a flexible rod part and arranged almost in parallel to and along the other sidewall part via a gap, wherein the wound spring type contact terminal is extended from the front end of the one side wall part of the frame;

wherein the leaf-spring type contact terminal is extended from a side edge of the bottom wall part of the frame through the flexible rod part; and wherein the one side wall part and the bottom wall part are arranged substantially orthogonal to each other.

2. The fuse terminal according to claim 1, wherein the wound spring type contact terminal has a first folding part which is extended from the front end of the one side wall part and then folded back within the frame and a second folding part which is extended from the tip end of the first folding part and then folded back so as to enter between the first folding part and the one side wall part.

3. The fuse terminal according to claim 1, wherein the leaf-spring type contact terminal is disposed that the tab terminal of the fuse inserted into the frame contacts to the leaf-spring type contact terminal prior to the wound spring type contact terminal.

4. The fuse terminal according to claim 1, wherein the wound spring type contact terminal and the leaf-spring type contact terminal elastically deforms at the time of the initial contact with the tab terminal.

5. The fuse terminal according to claim 1, wherein a folding part of the wound spring type contact terminal abuts against an inner surface of the one sidewall part when the tab terminal advancement is complete.

6. The fuse terminal according to claim 1, wherein the leaf-spring type contact terminal abuts against the other side wall when the tab terminal of the fuse is advanced into the frame and makes contact with the leaf-spring contact terminal.

7. The fuse terminal according to claim 1, wherein the flexible rod part has a plate part whose one end is connected to the side edge of the bottom wall part and a connecting part which connects the other end of the plate part with a side edge of the leaf-spring type contact terminal; and wherein the plate part is extended in a direction substantially perpendicular to the bottom wall part, and is arranged between the other side wall part and the leaf-spring type contact terminal.

* * * * *